US012251614B2

(12) United States Patent
Dietrich

(10) Patent No.: US 12,251,614 B2
(45) **Date of Patent: *Mar. 18, 2025**

(54) SPORT SWING TRAINING DEVICE

(71) Applicant: Eric Dietrich, Lake Park, FL (US)

(72) Inventor: Eric Dietrich, Lake Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/221,838

(22) Filed: Jul. 13, 2023

(65) Prior Publication Data

US 2024/0058681 A1 Feb. 22, 2024

Related U.S. Application Data

(63) Continuation of application No. 17/820,799, filed on Aug. 18, 2022, now Pat. No. 11,738,249.

(51) Int. Cl.
*A63B 69/36* (2006.01)

(52) U.S. Cl.
CPC .... *A63B 69/3673* (2013.01); *A63B 2069/367* (2013.01); *A63B 2214/00* (2020.08)

(58) Field of Classification Search
CPC ..... A63B 69/3673; A63B 2069/367; A63B 2214/00; A63B 21/0085; A63B 21/0125; A63B 2022/185
USPC ..... 473/207, 210, 217–219, 266, 269–273, 473/409
See application file for complete search history.

(56) References Cited

U.S. PATENT DOCUMENTS 3,352,559 A 11/1967 Larsen
4,023,810 A * 5/1977 Lorang ..... A63B 69/3673 473/218
4,037,847 A 7/1977 Lorang
4,088,325 A * 5/1978 Sutton ..... A63B 69/3667 472/110
5,263,863 A 11/1993 Stefani et al.
5,954,592 A 9/1999 Affer et al.
6,767,290 B1 7/2004 Tan
7,018,301 B1 * 3/2006 Cascerceri ..... A63B 69/3673 473/270
7,625,294 B1 * 12/2009 Isaac ..... A63B 69/3667 473/218
7,946,927 B2 5/2011 Bowers
11,738,249 B1 * 8/2023 Dietrich ..... A63B 69/3673 473/269
2006/0142099 A1 6/2006 Trucks
2009/0029789 A1 * 1/2009 Davies ..... A63B 69/3667 473/218
2012/0302363 A1 11/2012 Miller et al.

OTHER PUBLICATIONS

United States Patent and Trademark Office, U.S. Appl. No. 17/820,799, Notice of Allowance dated Apr. 18, 2023, 8 pages.

* cited by examiner

*Primary Examiner* — Nini F Legesse
(74) *Attorney, Agent, or Firm* — Polsinelli LLP; Adam P. Daniels

(57) ABSTRACT

A golf swing training device generally guides and trains a golf swing with a particular focus on weight transfers and hip rotations throughout the golf swing. The device includes a baseboard that provides a bottom fulcrum which aids an athlete in training a correct weight distribution throughout the golf swing. A pedal assembly, which includes a front pedal and a back pedal (corresponding to front/back feet), engages with a top fulcrum to aid the athlete in training correct hip rotation throughout the golf swing.

13 Claims, 14 Drawing Sheets

SPORT SWING TRAINING DEVICE

CROSS-REFERENCE TO RELATED APPLICATIONS

This application claims priority to and is a continuation of U.S. patent application Ser. No. 17/820,799, filed on Aug. 18, 2022, titled "A Sport Swing Training Device," the contents of which are incorporated herein by reference in its entirety.

TECHNICAL FIELD

The present disclosure relates generally to athletic training aids, and more particularly to a swing training device that aids in teaching balance and weight transfers throughout a swing movement.

BACKGROUND

A proper swing in many sports, e.g., golf, baseball, softball, hockey, tennis, and so on, typically involves a complex set of movements, weight transfers, hip rotations, hand-eye-coordination, body positioning, and the like. Collectively, the mechanics of these complex movements generate a force throughout the swing to strike an object such as a ball, a puck, etc. As one example, a proper golf swing involves a weight transfer between a back foot and a front foot, a downward movement of a golf club, and a corresponding hip rotation to generate torque and strike a golf ball. However, teaching and practicing the proper swing is often difficult without direct feedback from an instructor, and mastering the proper swing often requires consistent practice employing correct swing mechanics. Consistent practice, in turn, helps develop appropriate muscle memory such that a proper swing becomes more natural and instinctive.

Proper swing fundamentals often begin with ground contact and foot positioning, which dictate a direction and an amount of striking force generated throughout a swing. For example, stabilization and balance help an athlete efficiently transfer weight between feet, rotate hips, and generate powerful striking forces. Without stabilization or balance, the athlete's swing can become erratic and inconsistent.

BRIEF DESCRIPTION OF THE DRAWINGS

The embodiments herein may be better understood by referring to the following description in conjunction with the accompanying drawings in which like reference numerals indicate identical or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION OF EXAMPLE EMBODIMENTS

Overview

Figure 1:
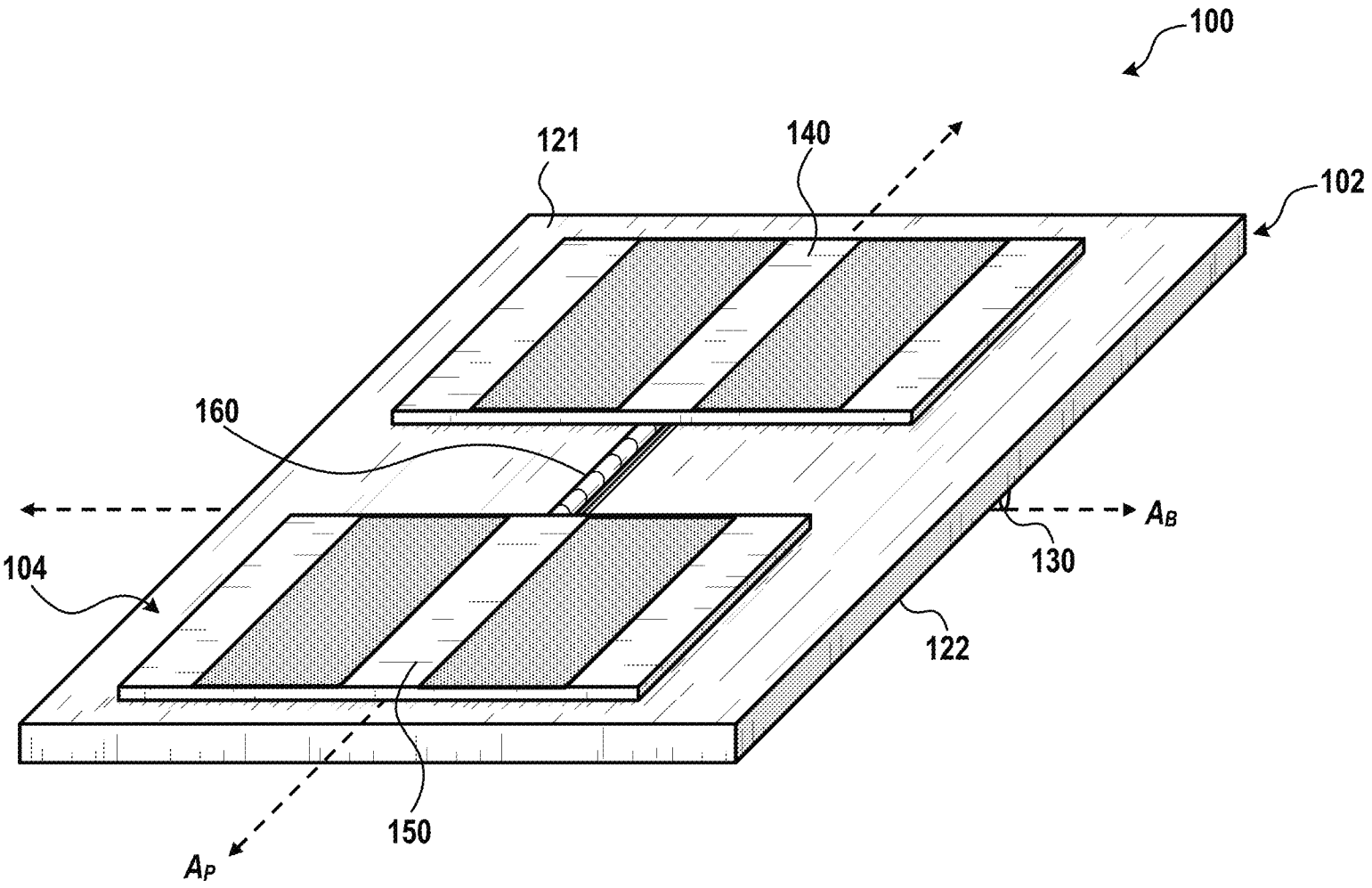
FIG. 1 illustrates a perspective view of a golf training device, showing a baseboard and a pedal assembly having two pedals—namely, a front pedal and a back pedal.

According to one or more embodiments of this disclosure, a swing training device ("device") generally guides and trains a swing, such as a golf swing, with a particular focus on weight transfers and rotations throughout the swing (e.g., backswing, to downswing, to follow-through). The device includes a baseboard and foot pedals that are balanced on respective fulcrums. For example, the baseboard has a "bottom" fulcrum positioned along a longitudinal midline of its bottom surface, which allows the baseboard to rotate between a "backswing tilt" position and a "follow-through tilt" position. The baseboard also has a "top" fulcrum positioned along a lateral midline of a top surface of the baseboard. A pedal assembly, which includes a front pedal and a back pedal (corresponding to front and back feet), engages with the top fulcrum. Each pedal can separately or independently articulate about the top fulcrum between the backswing tilt position and the follow-through tilt position. In some embodiments, the device enables "yaw" rotation of the front pedal and the back pedal to accommodate pivoting of the front foot and the back foot during the golf swing. For example, a golfer stands on the pedal assembly with a front foot placed on the front pedal and with a back foot placed on the back pedal. During the golf swing, the golfer shifts their weight from their back foot to their front foot and rotates their hips to generate a striking force. As the golfer shifts their weight, the baseboard rotates relative to the bottom fulcrum, and as the golfer rotates their hips, the front pedal and the back pedal individually articulate or rotate relative to the top fulcrum. In this fashion, the swing training device facilitates stabilization and balance to help the golfer efficiently transfer weight between feet, rotate hips, and generate powerful striking forces. These and other features will be discussed herein with respect to various exemplary embodiments of the disclosed golf swing training device.

DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

References to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

As used herein, direction or relational terms such as "front," "back," "left," "right," "top," and "bottom" are used to facilitate understanding and discussion, not limitation. For example, these terms generally provide context for viewing embodiments and associated components. Similarly, the term "longitudinal" generally refers to an orientation or direction relative to an axis of elongation, whereas "lateral" refers to an orientation or direction that is generally perpendicular to the axis of elongation.

Referring to the figures, FIG. 1 illustrates a swing training device 100 that facilitates shifting an athlete's weight throughout a well-executed swing, which can include shifting the weight between a beginning "backswing" position and an end "follow-through" position. Swing training device 100 features a baseboard 102 having a bottom surface 122 rotatably coupled to a bottom fulcrum 130 that defines a baseboard axis $A_B$ of rotation. Baseboard 102 rotates about bottom fulcrum 130 between a backswing tilt position and a follow-through tilt position that respectively correspond with the beginning "backswing" position and the end "follow-through" position of a well-executed swing.

Swing training device 100 also includes a pedal assembly 104 positioned along a top surface 121 of baseboard 102. Pedal assembly 104 features a front pedal 140 and a back pedal 150 separately mounted along a top fulcrum 160 that defines a pedal axis $A_P$ of rotation. Front pedal 140 and back pedal 150 each independently rotate about pedal axis $A_P$ between the backswing tilt position and the follow-through tilt position.

Figure 2A:
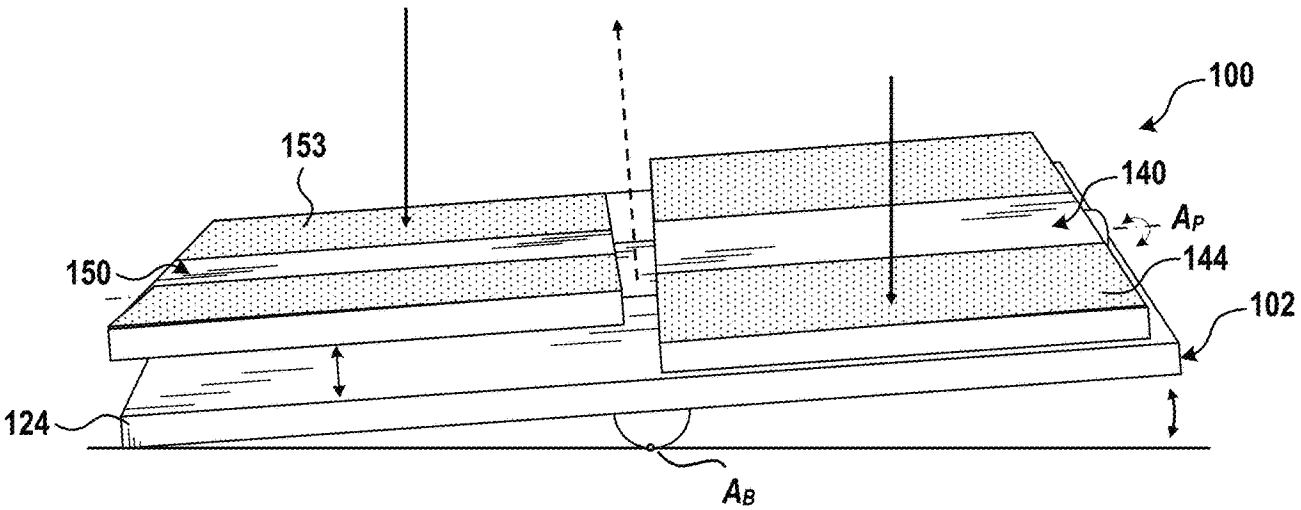
FIGS. 2A and 2B illustrate side views of the golf training device of FIG. 1, showing a "backswing tilt" position and a "follow-through" tilt position.
Figure 2B:
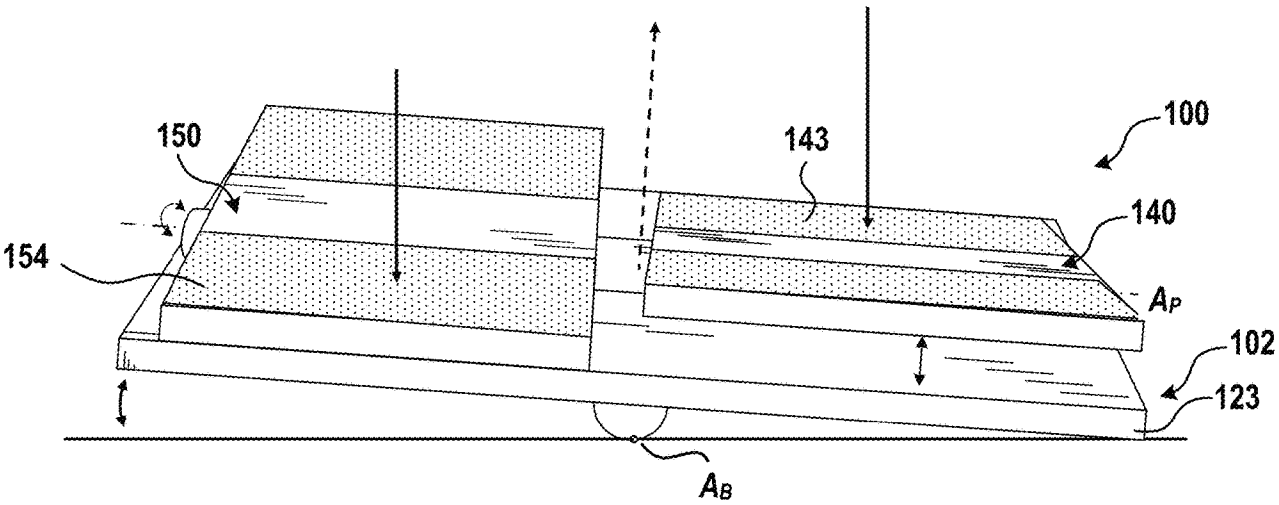
Figure 4C:
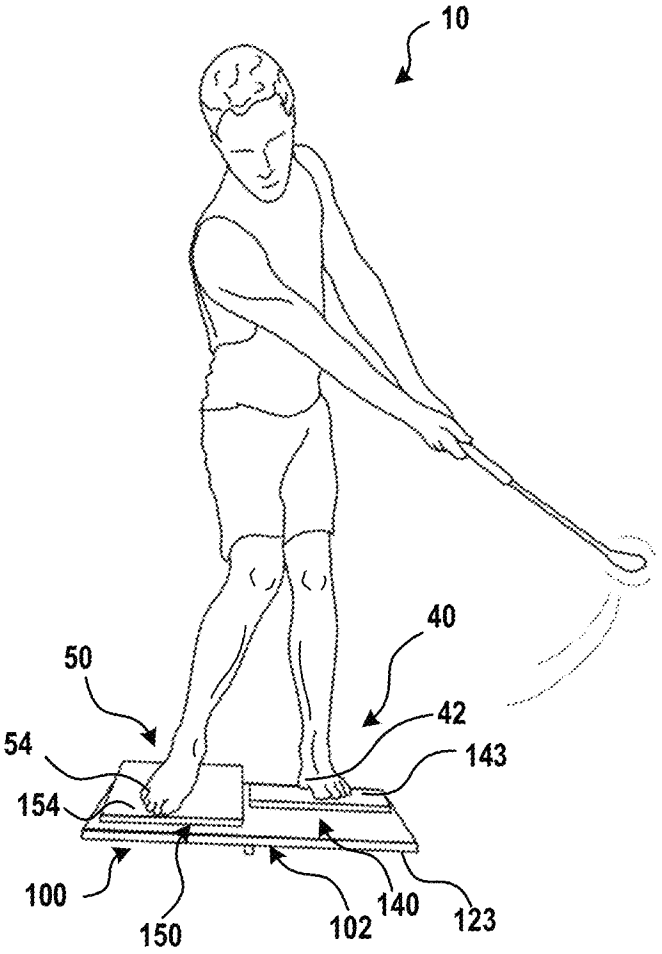
FIGS. 4A-4C illustrate a progression of views for a golf swing aided by the golf training device of FIG. 1, including an initial-swing view that corresponds with the "backswing tilt" position, a transitional mid-swing view, and an ending-swing view that corresponds with the "follow-through" tilt position.
Figure 4B:
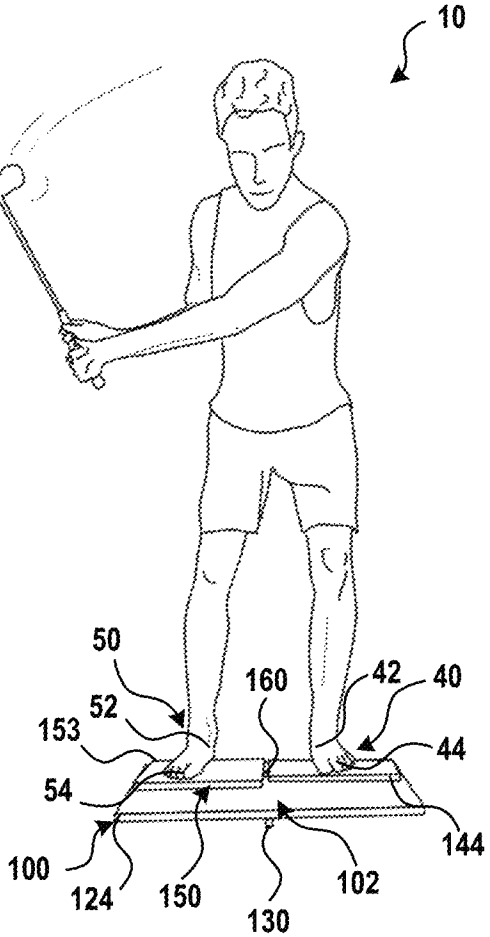
Figure 4A:
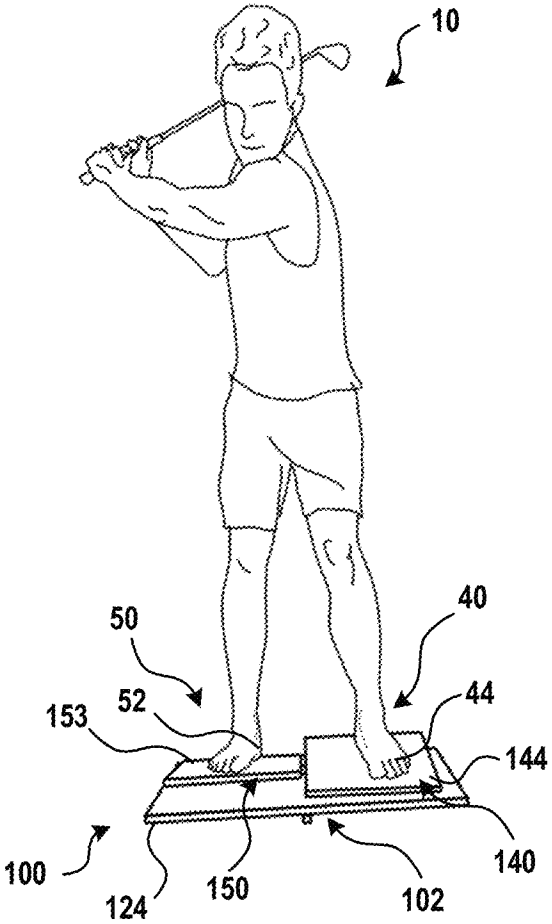

FIGS. 2A and 2B respectively illustrate different swing positions for swing training device 100, including the backswing tilt position and the follow-through tilt position. Notably, the positions of swing training device 100 illustrated in FIGS. 2A and 2B are generally viewed from a front-facing perspective—e.g., ref. FIGS. 4A-C (showing a front-facing perspective of a golf swing aided by swing training device 100).

Referring to FIG. 2A, a proper weight distribution in a backswing corresponds to an athlete loading their weight on their back foot at the start of a swing. Accordingly, the athlete places a majority of their weight on their back foot relative to their front foot during the backswing. As shown in FIG. 2A, swing training device 100 facilitates the proper backswing weight distribution by tilting baseboard 102 about baseboard axis $A_B$ such that a back portion 124 of baseboard 102 contacts a ground surface.

In addition to proper weight distribution, proper hip rotation during the backswing corresponds to a twisting motion where the athlete lifts their front heel of the front foot and shifts their weight to the back heel of the back foot in a "grounding" motion at the back heel of the back foot, such that the hips of the user are directed towards their back foot. For example, still referring to FIG. 2A, swing training device 100 facilitates proper hip rotation by rotating back pedal 150 about pedal axis $A_P$ such that a back heel portion 153 of back pedal 150 contacts baseboard 102, and independently rotating front pedal 140 about pedal axis $A_P$ such that a front toe portion 144 of front pedal 140 contacts baseboard 102.

Conversely, a proper weight distribution in a follow-through swing corresponds to an athlete transitioning their weight towards their front foot and away from their back foot at the conclusion of a swing. In the follow-through tilt position shown in FIG. 2B, swing training device 100 facilitates the proper follow-through weight distribution by tilting baseboard 102 about the baseboard axis $A_B$ such that a front portion 123 of baseboard 102 contacts the ground surface. In addition to proper weight distribution, proper hip rotation during the follow-through swing corresponds to a twisting motion where the athlete lifts their back heel of the back foot and shifts their weight to the front heel of the front foot in a "grounding" motion at the front heel of the front foot, such that the hips of the user are directed towards their front foot. For example, still referring to FIG. 2B, swing training device 100 facilitates proper hip rotation by rotating back pedal 150 about pedal axis $A_P$ such that a back toe portion 154 of back pedal 150 contacts baseboard 102 and front pedal 140 rotates about pedal axis $A_P$ such that a front heel portion 143 of front pedal 140 contacts baseboard 102.

Figure 3A:
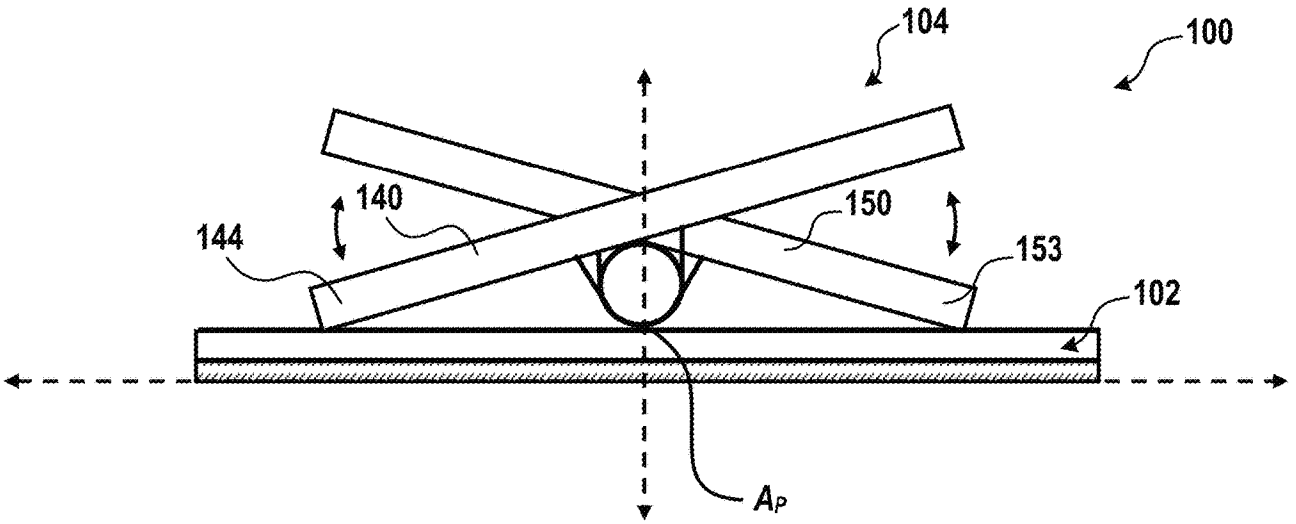
FIGS. 3A and 3B illustrate side elevation views of the foot pedal assembly of the golf training device of FIG. 1, showing respective independent rotation of the front foot pedal and the back foot pedal about a pedal axis.
Figure 3B:
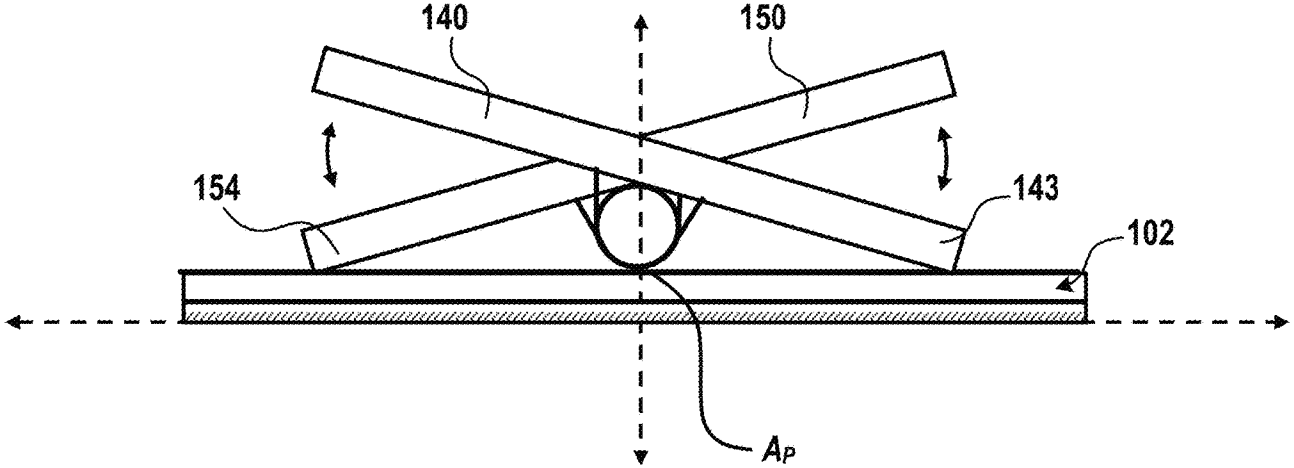

The motion of pedal assembly 104 relative to baseboard 102 is further illustrated in the elevated side views of FIGS. 3A and 3B. In the example shown, baseboard 102 is stabilized for simplicity. FIG. 3A shows pedal assembly 104 in the backswing tilt position where back heel portion 153 of back pedal 150 and front toe portion 144 of front pedal 140 rotate about pedal axis $A_P$ in opposite directions relative to one another to contact baseboard 102. FIG. 3B shows pedal assembly 104 in the follow-through tilt position where back toe portion 154 of back pedal 150 and front heel portion 143 of front pedal 140 rotate about pedal axis $A_P$ in opposite directions relative to one another to contact baseboard 102.

FIGS. 4A-4C illustrate the principles and proper swing mechanics described above with an athlete 10 standing on swing training device 100 having a front foot 40 on front pedal 140 and a back foot 50 on back pedal 150. As discussed herein, swing training device 100 provides feedback when executing a swing to indicate proper weight distribution and balance between each stage of the swing. Collectively, athlete 10 starts a swing in the backswing tilt position in FIG. 4A, transitions to a mid-swing position in FIG. 4B, and finishes the swing in a follow-through tilt position in FIG. 4C.

Referring to FIG. 4A and as mentioned above, in the backswing tilt position, athlete 10 distributes their weight such that most of their weight is on their back foot 50 as is required for proper weight distribution. The athlete should also rotate their hips towards their back foot 50 such that the majority of their weight is on a back heel 52 of their back foot 50, and the minority of their weight is on a front toe 44 of their front foot 40. As the athlete executes the backswing with proper weight distribution, baseboard 102 assumes the backswing tilt position by tilting about baseboard axis $A_B$ such that back portion 124 of baseboard 102 contacts the ground surface. As the athlete executes the backswing with proper hip rotation towards their back foot 50, the front pedal 140 and the back pedal 150 rotate about pedal axis $A_P$ in opposite directions relative to one another such that back heel portion 153 of back pedal 150 and front toe portion 144 of front pedal 140 contact baseboard 102, which is reflective of the athlete's hips being rotated towards their back foot 50 as they "ground" their back heel 52 towards the ground surface and extend their front leg. If the backswing is poorly executed, then the swing training device 100 provides feedback to the athlete by not assuming the backswing tilt position of FIG. 4A to reflect the athlete's failure to properly distribute their weight or rotate their hips towards their back foot 50 as required; additionally, the athlete might lose their balance.

FIG. 4B illustrates the transition between the backswing tilt position of FIG. 4A and the follow-through tilt position of FIG. 4C, in which the athlete begins to shift their weight away from back foot 50 positioned on back pedal 150 and towards front foot 40 positioned on front pedal 140. As the athlete executes the transition between the backswing tilt position and the follow-through tilt position with proper weight distribution, the baseboard 102 tilts about baseboard axis $A_B$ to raise the back portion 124 of baseboard 102 above the ground surface such that baseboard 102 momentarily balances across bottom fulcrum 130. Further, as the athlete executes the transition between the backswing tilt position and the follow-through tilt position with proper hip rotation, the front pedal 140 and the back pedal 150 rotate about pedal axis $A_P$ in opposite directions relative to one another to raise back heel portion 153 of back pedal 150 and front toe portion 144 of front pedal 140 above the baseboard 102 such that front pedal 140 and back pedal 150 momentarily balance across top fulcrum 160, which is reflective of the athlete's hips rotating towards the center while shifting weight from back heel 52 to a back toe 54 of back foot 50 and from front toe 44 to a front heel 42 of front foot 40. If the transition is poorly executed, for instance, if the athlete fails to shift their weight from the back foot 50 to the front foot 40 (weight distribution) while simultaneously shifting weight from back heel 52 to back toe 54 of back foot 50 and from front toe 44 to front heel 42 of front foot 40 (hip rotation), then as a result baseboard 102 and pedal assembly 104 will not transition simultaneously in one fluid motion, and the athlete could potentially lose their balance.

Further, in the follow-through tilt position of FIG. 4C, athlete 10 re-distributes their weight such that most of their weight is on their front foot 40 as required for proper weight distribution. The athlete should also rotate their hips towards their front foot 40 such that the majority of their weight is on front heel 42 of their front foot 40, and the minority of their weight is on back toe 54 of their back foot 50. As the athlete executes the follow-through swing with proper weight distribution, baseboard 102 assumes the follow-through tilt position by tilting about baseboard axis $A_B$ such that front portion 123 of baseboard 102 contacts the ground surface. As the athlete executes the follow-through swing with proper hip rotation towards their front foot 40, the front pedal 140 and the back pedal 150 rotate about pedal axis $A_P$ in opposite directions relative to one another such that front heel portion 143 of front pedal 140 and back toe portion 154 of back pedal 150 contact baseboard 102, which is reflective of the athlete's hips being rotated towards their front foot 40 as they "ground" their front heel 42 towards the ground surface and extend their back leg. If the follow-through swing is poorly executed, then the swing training device 100 provides feedback to the athlete by not assuming the follow-through tilt position of FIG. 4C to reflect the athlete's failure to properly distribute their weight or rotate their hips towards their front foot 40 as required; additionally, the athlete might lose their balance.

As shown in FIGS. 4A-4C, swing training device 100 facilitate proper weight distribution and balance and provides feedback throughout a golf swing. In particular, swing training device 100 aids the athlete in understanding proper weight distribution and hip rotation during each stage of a golf swing by constraining weight distribution between the back foot 50 and the front foot 40, and constraining hip rotation by constraining weight distribution between back heel 52 and back toe 54 of back foot 50 and back heel 42 and back toe 44 of front foot 40. By constraining the weight distribution of the athlete between their front foot 40 and the back foot 50, swing training device 100 enables the athlete to focus on proper weight distribution by clearly reflecting where the majority of the athlete's weight is placed at each stage of the swing. Further, by constraining the weight distribution of the athlete between the back heel 52 and back toe 54 of back foot 50 and back heel 42 and back toe 44 of front foot 40, the swing training device 100 enables the athlete to focus on proper hip rotation by clearly reflecting the "direction" at which the athlete's weight distributes when rotating their hips at each stage of the golf swing (i.e., hips rotated towards their back foot 50 with "grounded" back heel 52 and extended front leg, hips rotated towards the center with equal heel-toe balance, or hips rotated towards their front foot 40 with "grounded" front heel 42 and extended back leg). As such, the swing training device 100 provides an objective reflection of weight distribution, hip rotation, and overall balance at each stage of the golf swing. By iteratively practicing the golf swing such that swing training device 100 properly reflects the backswing tilt position, transitional position, and follow-through tilt position during the golf swing shown in FIGS. 4A-4C, the athlete can develop muscle memory for proper swing mechanics.

The example shown in FIGS. 4A-4C feature a right-handed athlete in which their back foot 50 is their right foot, their front foot 40 is their left foot, and an intended direction of the swing is from their right side to their left side. In a well-executed swing, the weight of the right-handed athlete should shift from their back foot 50 (right foot) in the backswing tilt position of FIG. 4A, to their front foot 40 (left foot) in the follow-through tilt position of FIG. 4C. FIG. 4B illustrates the transitional mid-swing position in which their weight is momentarily equalized across the swing training device 100 before shifting into the follow-through tilt position of FIG. 4C.

However, it should be noted that the principles described herein can also extend to a left-handed athlete as well. In the case of a left-handed athlete, their back foot is their left foot, their front foot is their right foot, and an intended direction of the swing is from their left side to their right side. In a well-executed swing, the weight of the left-handed athlete should shift from their back foot (left foot) in the backswing tilt position analogous to FIG. 4A, to their front foot (right foot) in the follow-through tilt position analogous to FIG. 4C. The left-handed athlete would also experience the transitional mid-swing position analogous to FIG. 4B in which their weight momentarily equalizes across the swing training device 100 before shifting into the follow-through tilt position analogous to FIG. 4C.

Figure 5:
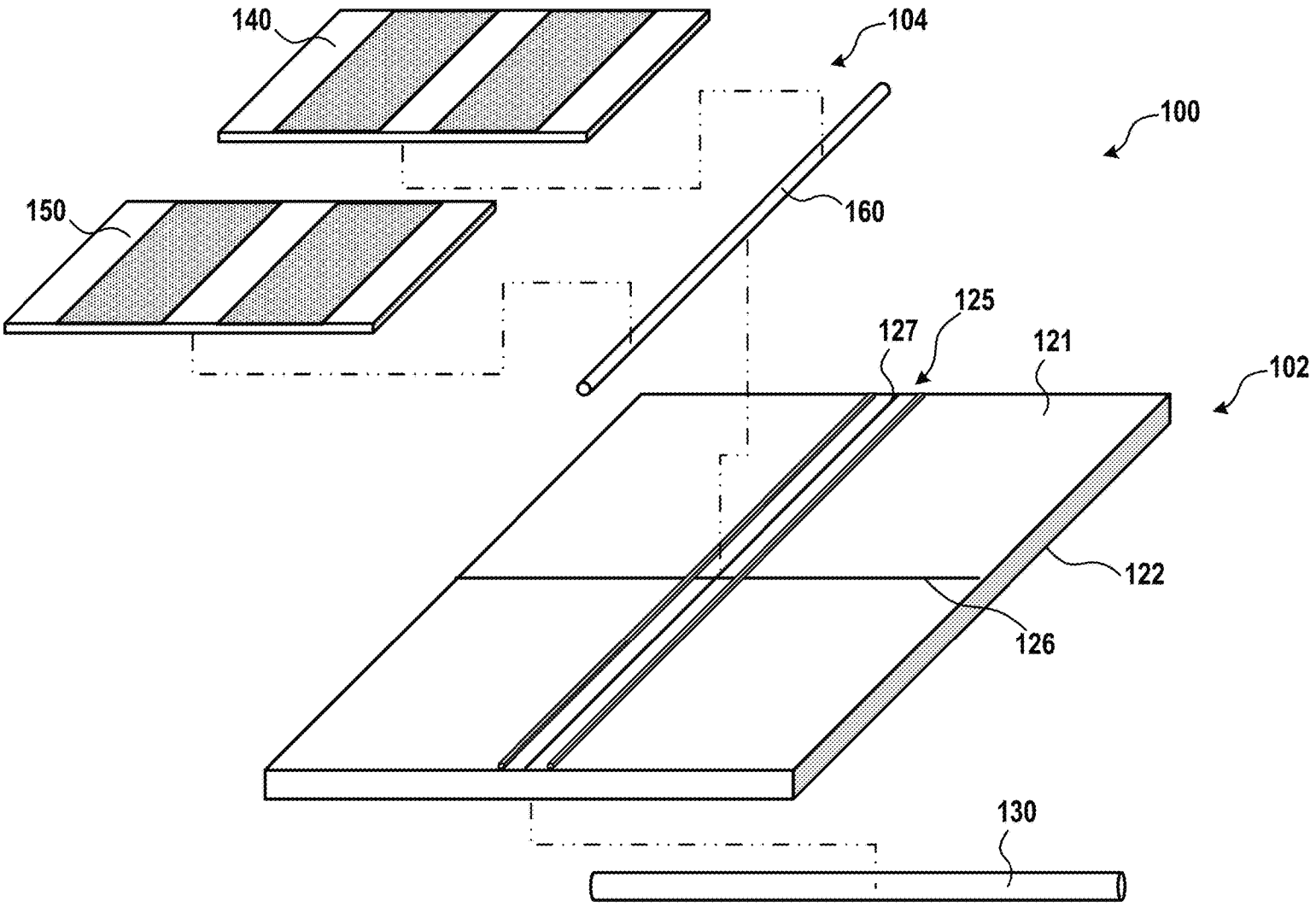
FIG. 5 illustrates an exploded view of the golf training device of FIG. 1, showing a top fulcrum positioned on a top surface of the baseboard and a bottom fulcrum positioned on a bottom surface of the baseboard.
Figure 6A:
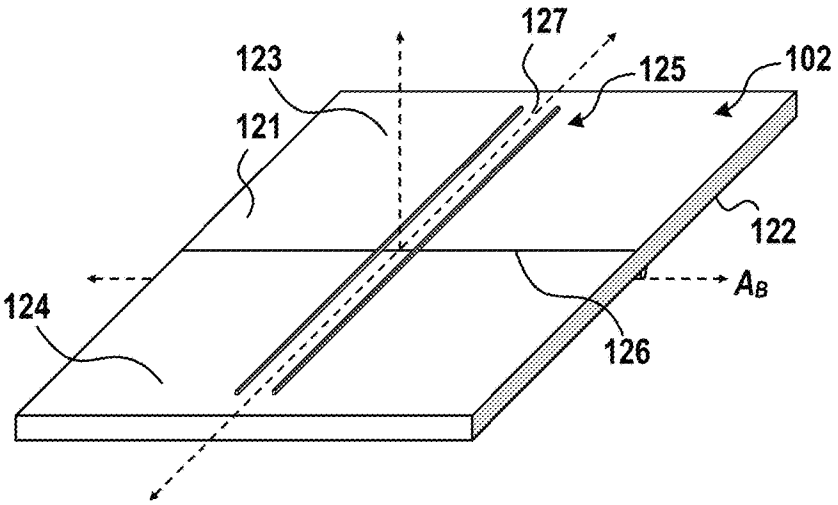
FIGS. 6A-6D illustrate a set of views of the baseboard of the golf training device of FIG. 1, showing a top perspective view, a top plan view, a side elevation view, and a bottom plan view.
Figure 6B:
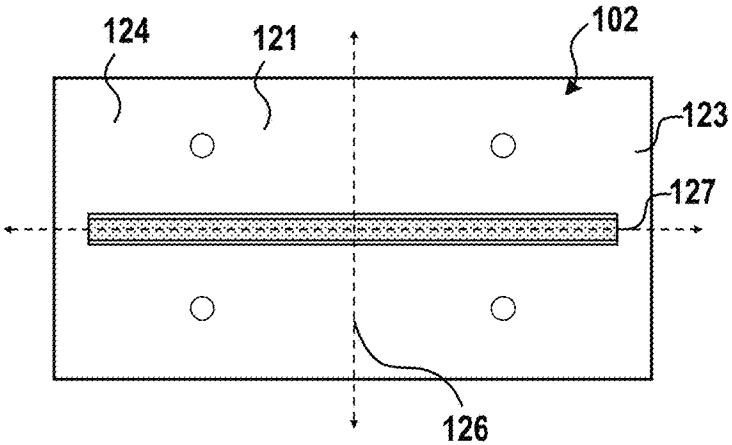
Figure 6C:
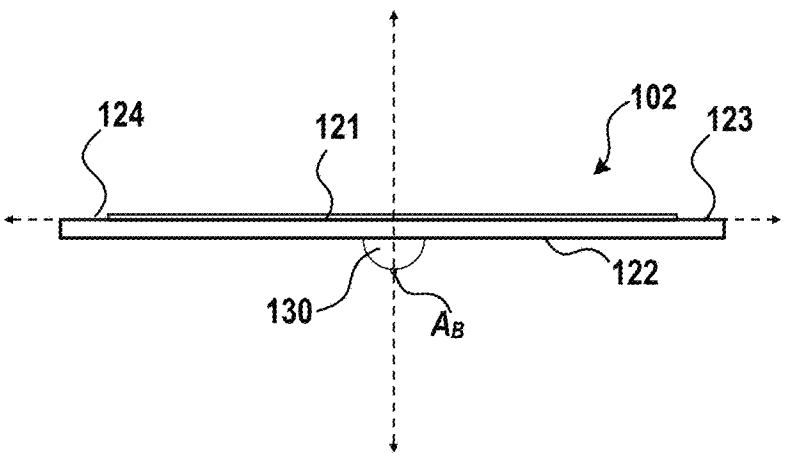
Figure 6D:
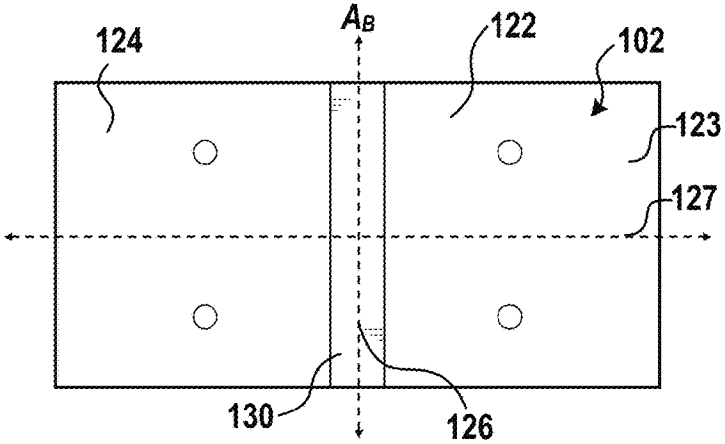
Figure 7A:
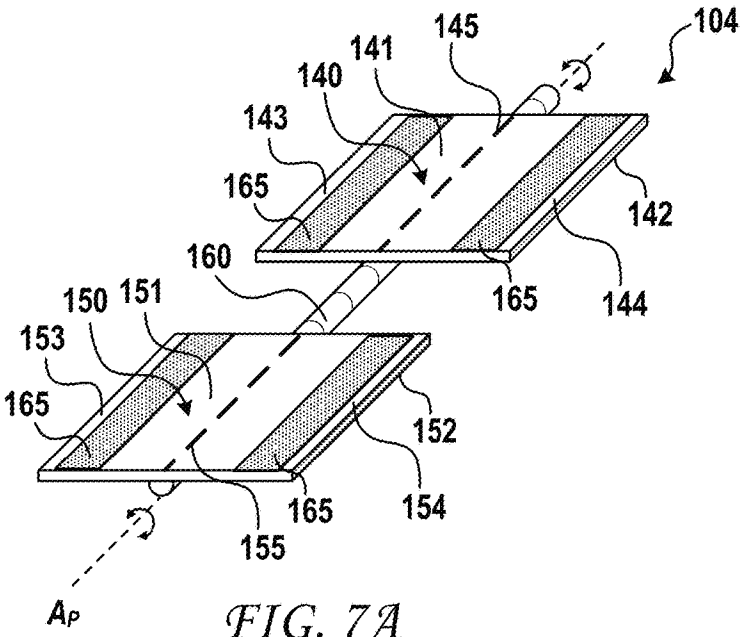
FIGS. 7A-7D illustrate a set of views of the pedal assembly of the golf training device of FIG. 1, showing a top perspective view, a bottom perspective view, a top plan view and a bottom plan view.
Figure 7B:
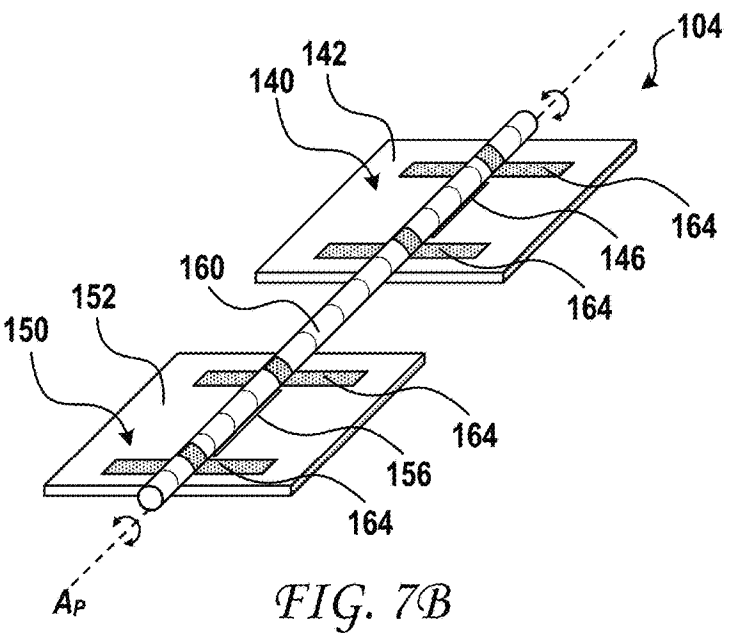
Figure 7C:
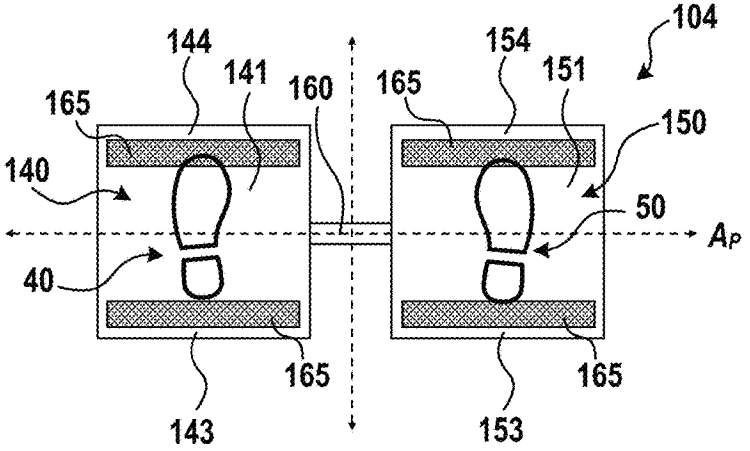
Figure 7D:
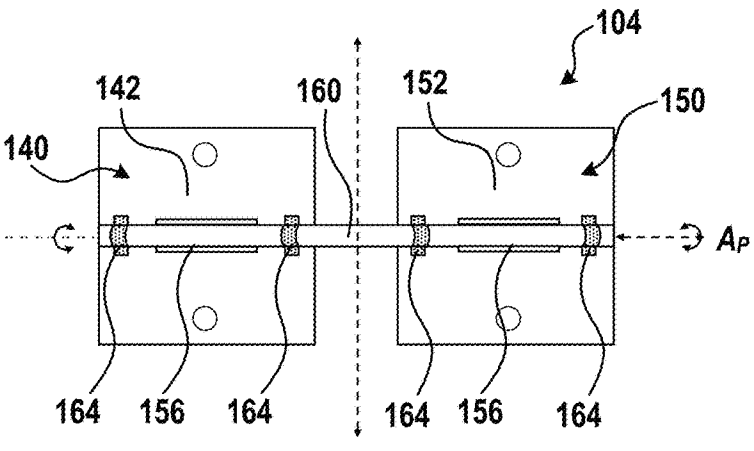

FIG. 5 illustrates an exploded view of swing training device 100. As shown, baseboard 102 includes top surface 121 and bottom surface 122 opposite top surface 121. Bottom fulcrum 130 couples with bottom surface 122 along a lateral midline 126 (e.g., the "short" axis) of baseboard 102. Similarly, top fulcrum 160 couples with top surface 121 along a longitudinal midline 127 (e.g., the "long" axis) of baseboard 102. In some embodiments, top surface 121 of baseboard 102 defines a top fulcrum receptacle 125 along longitudinal midline 127 that captures top fulcrum 160. Top fulcrum receptacle 125 can be made in multiple variations, as will be illustrated in further detail below.

In some embodiments, top fulcrum 160 couples with front pedal 140 and back pedal 150 to form pedal assembly 104 prior to engagement with baseboard 102. However, in other embodiments as will be discussed in greater with respect to further figures (FIGS. 10C and 10D), top fulcrum 160 can be integral with baseboard 102 for individual coupling with front pedal 140 and back pedal 150. Optionally, as will also be shown in greater detail below and in further figures (FIGS. 9A and 9B), top fulcrum 160 can be divided into a front top fulcrum and a back top fulcrum which are each integral with their associated front pedal 140 and back pedal 150.

FIGS. 6A-6D illustrate one embodiment of baseboard 102. As mentioned above, baseboard 102 has top surface 121 and bottom surface 122, with bottom fulcrum 130 positioned along lateral midline 126 on bottom surface 122 of baseboard 102. Bottom fulcrum 130 provides baseboard axis $A_B$ which baseboard 102 rotates about during transition between the backswing tilt position and the forward-tilt position. In this example, bottom fulcrum 130 has a semi-circular cross section, however it should be noted that bottom fulcrum 130 is not limited to this shape and that alternative examples are further provided herein. Baseboard 102 defines top fulcrum receptacle 125 positioned along longitudinal midline 127 on top surface 121 of baseboard 102 which receives top fulcrum 160 of pedal assembly 104 (FIGS. 7A-7D). Baseboard 102 and corresponding bottom fulcrum 130 provide feedback to the athlete to train proper weight distribution between the backswing tilt position and the follow-through tilt position. In particular, baseboard 102 facilitates the proper backswing weight distribution by rotating about baseboard axis $A_B$ such that back portion 124 of baseboard 102 contacts the ground surface to reflect the athlete placing their weight on their back foot and facilitates the proper follow-through weight distribution by tilting baseboard 102 about baseboard axis $A_B$ such that front portion 123 of baseboard 102 contacts the ground surface to reflect the athlete placing their weight on their front foot.

FIGS. 7A-7D illustrate one embodiment of the pedal assembly 104. As shown, pedal assembly 104 includes front pedal 140, back pedal 150 and top fulcrum 160 that defines pedal axis $A_P$. The front pedal 140 has a top surface 141, a bottom surface 142, front heel portion 143, and front toe portion 144. A front pedal midline 145 divides front heel portion 143 and front toe portion 144. Similarly, back pedal 150 also has a top surface 151, a bottom surface 152, back heel portion 153, and back toe portion 154. A back pedal midline 155 divides back heel portion 153 and back toe portion 154. As shown, top fulcrum 160 couples along respective bottom surfaces 142 and 152 of front pedal 140 and back pedal 150. Bottom surface 142 of front pedal 140 includes a fulcrum seat 146 along front pedal midline 145 for receipt and alignment of top fulcrum 160. Similarly, bottom surface 152 of back pedal 150 includes a fulcrum seat 156 along back pedal midline 155 for receipt and alignment of top fulcrum 160. In the embodiment of FIGS. 7A-7D, top fulcrum 160 couples to front pedal 140 and back pedal 150 by a plurality of straps 164 that enable individual rotation of front pedal 140 and back pedal 150 about the top fulcrum 160 while securing top fulcrum 160 along front pedal midline 145 and back pedal midline 155. In this example, top fulcrum 160 has a circular cross section, however it should be noted that top fulcrum 160 is not limited to this shape and that alternative examples are further provided herein. As further illustrated, top surfaces 141 and 151 of front pedal 140 and back pedal 150 can each include one or more grip tape segments 165 or another similar material that provides friction to prevent the athlete from slipping when standing on pedal assembly 104. Pedal assembly 104 and corresponding top fulcrum 160 provide feedback to the athlete to train proper hip rotation between the backswing tilt position and the follow-through tilt position. In particular, pedal assembly 104 facilitates the proper backswing hip rotation by rotating about pedal axis $A_P$ such that back heel portion 153 of back pedal 150 and front toe portion 144 of front pedal 140 contact the baseboard 102 to reflect the athlete "grounding" their weight on their back heel and extending their front leg as their hips rotate towards the back foot. Similarly, pedal assembly 104 facilitates the proper follow-through hip rotation by rotating about pedal axis $A_P$ such that back toe portion 154 of back pedal 150 and front heel portion 143 of front pedal 140 contact the baseboard 102 to reflect the athlete "grounding" their weight on their front heel and extending their back leg as their hips rotate towards the front foot.

Figure 8A:
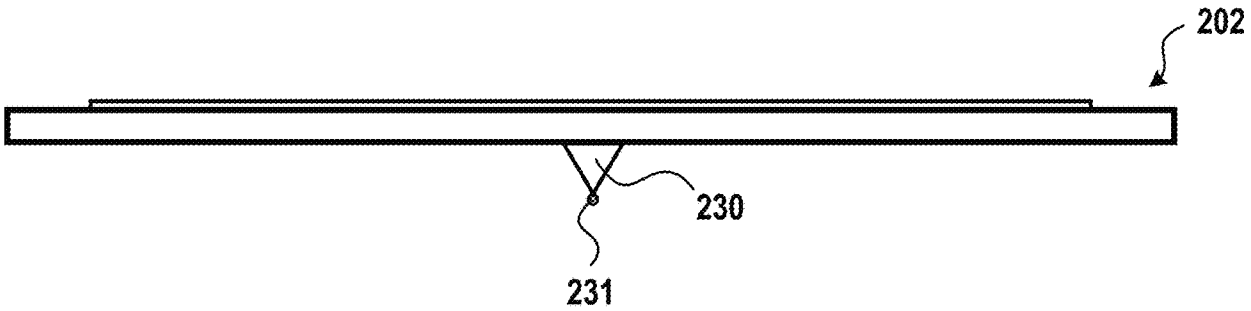
FIGS. 8A-8C illustrate a set of side elevation views of various embodiments of the bottom fulcrum of the golf training device of FIG. 1.
Figure 8B:
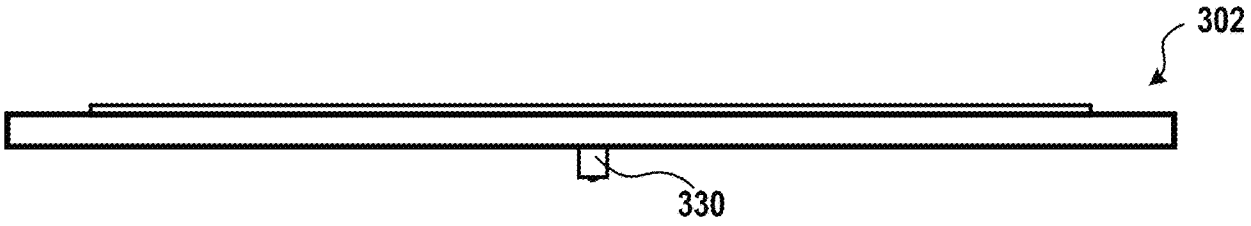
Figure 8C:
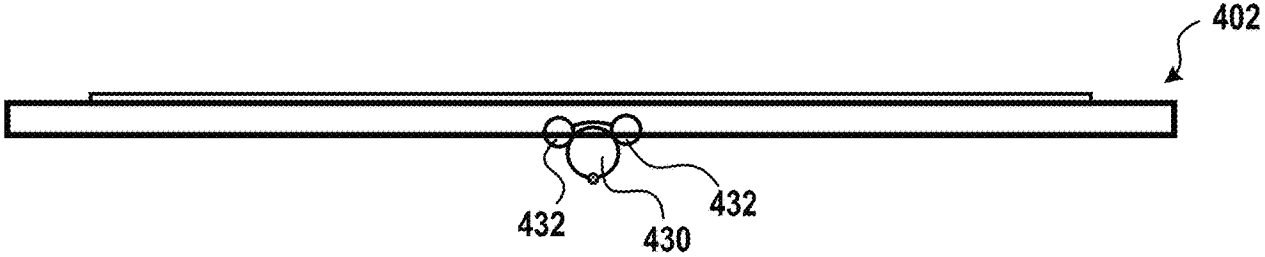

FIGS. 8A-8C illustrate various alternative embodiments of baseboard 102 featuring alternative embodiments of bottom fulcrum 130. For instance, in FIG. 8A, a baseboard 202 can include bottom fulcrum 230 that has a triangular shape, with an apex 231 of the bottom fulcrum 230 facing towards a ground surface. FIG. 8B shows an embodiment of a baseboard 302 featuring a bottom fulcrum 330 that has a square shape. Bottom fulcrum 330 may provide additional stability when stepping onto the swing training device 100 or in the transitional mid-swing position of FIG. 4B, which can be beneficial for younger athletes or for athletes with balance or coordination difficulties. FIG. 8C shows an embodiment of baseboard 402 featuring a bottom fulcrum 430 that is coupled with one or more resistive rollers 432 that resist rotation due to friction, requiring additional effort from the athlete to train their swing with variable resistance. Bottom fulcrum 430 is one of multiple examples of a resistive mechanism of the swing training device 100 that will be described in further detail below. It should be noted that while specific examples of alternative shapes of bottom fulcrum 130 are provided, bottom fulcrum 130 is not limited to these.

Figure 9B:
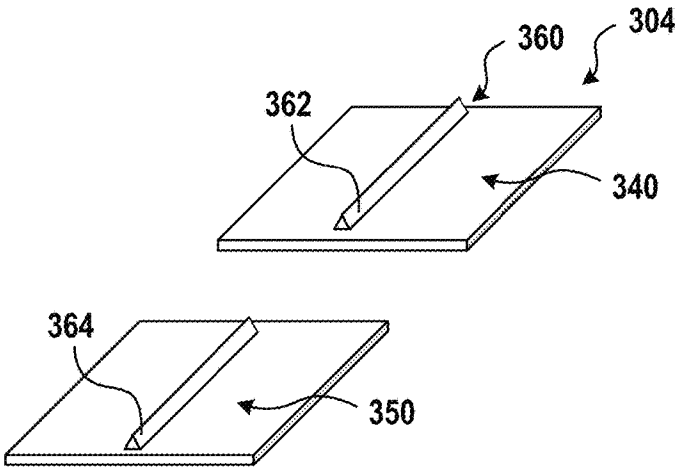
FIGS. 9A-9D illustrate a set of below perspective views of various embodiments of the pedal assembly of FIG. 1 featuring various types of top fulcrums and top fulcrum seats.
Figure 9A:
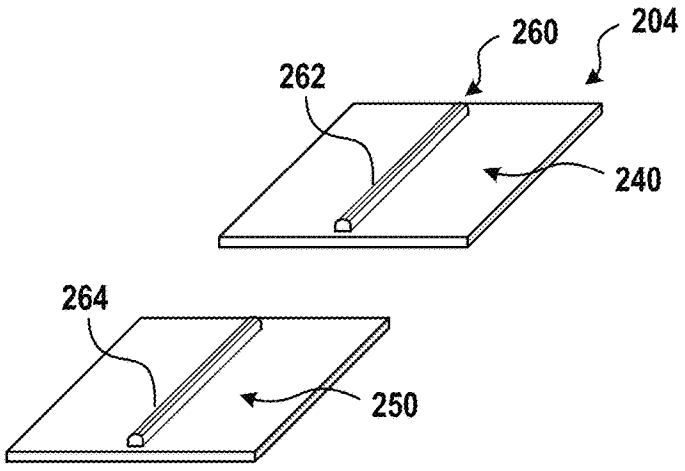

FIGS. 9A-9D illustrate bottom perspective views of various alternative embodiments of the pedal assembly 104. In particular, FIG. 9A includes a pedal assembly 204 featuring a front top fulcrum 262 and a back top fulcrum 264 that collectively form a top fulcrum 260 and are each respectively integral with a front pedal 240 and a back pedal 250 of pedal assembly 204. This and allows positioning of front pedal 240 and back pedal 250 at variable stance widths along top fulcrum receptacle 125 (FIGS. 6A-6D) of the baseboard 102. As shown, front top fulcrum 262 and back top fulcrum 264 of top fulcrum 260 have a semi-circular or rounded cross section. FIG. 9B illustrates a similar pedal assembly 304 featuring a front top fulcrum 362 and a back top fulcrum 364 that collectively form a top fulcrum 360 and are each respectively integral with a front pedal 340 and a back pedal 350 of the pedal assembly 304, the exception being that front top fulcrum 362 and back top fulcrum 364 of the top fulcrum 360 have a triangular cross-section. Optionally, front top fulcrum 262 or 362 and back top fulcrum 264 or 364 can be connected by a rotational bearing (not shown) located between front top fulcrum 262 or 362 and back top fulcrum 264 or 364.

Figure 9D:
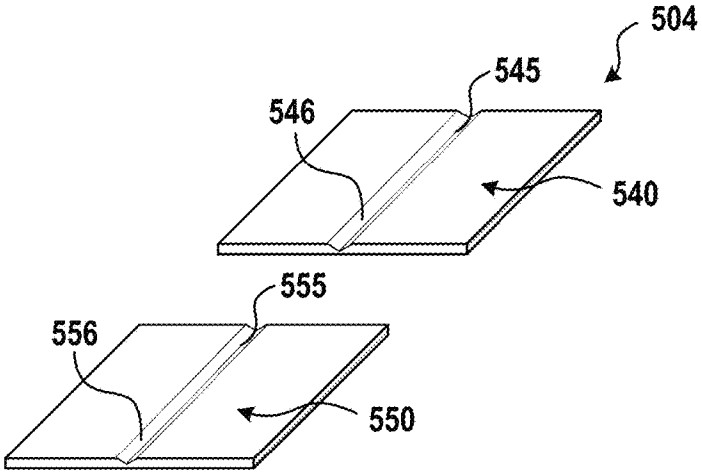
Figure 9C:
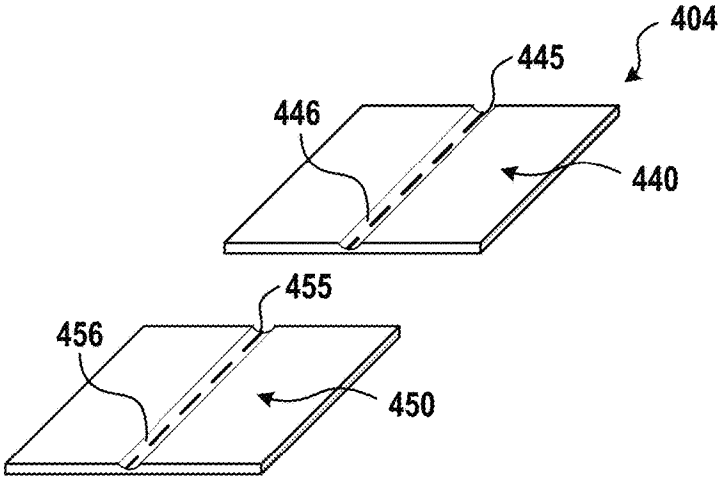

FIG. 9C illustrates a pedal assembly 404 that includes a front fulcrum seat 446 along a front pedal midline 445 of a front pedal 440 and a back fulcrum seat 456 along a back pedal midline 455 of a back pedal 450 for receipt and alignment of top fulcrum 160 (FIGS. 7A-7D). In the embodiment of FIG. 9C, front fulcrum seat 446 and back fulcrum seat 456 each define a semi-circular or rounded cross-section. FIG. 9D illustrate a similar pedal assembly 504 that includes a front fulcrum seat 546 defined along a front pedal midline 545 of a front pedal 540 and a back fulcrum seat 556 defined along a back pedal midline 555 of a back pedal 550 for receipt and alignment of top fulcrum 160. In the embodiment of FIG. 9D, front fulcrum seat 546 and back fulcrum seat 556 each define a triangular or pointed cross-section.

Referring to FIGS. 10A-10D, arrangements of various alternative baseboards and alternative pedal assemblies are illustrated. A baseboard 602 of FIG. 10A includes a top fulcrum receptacle 625 that interfaces with a top fulcrum 660 associated with a pedal assembly 604. As shown, top fulcrum receptacle 625 defines a semi-circular or rounded cross-section that interfaces with the semi-circular or rounded cross-section of top fulcrum 660. A baseboard 702 of FIG. 10B includes a top fulcrum receptacle 725 that interfaces with a top fulcrum 760 associated with a pedal assembly 704. As shown, top fulcrum receptacle 725 defines a triangular or pointed cross-section that interfaces with the triangular or pointed cross-section of the top fulcrum 760.

Figure 10A:
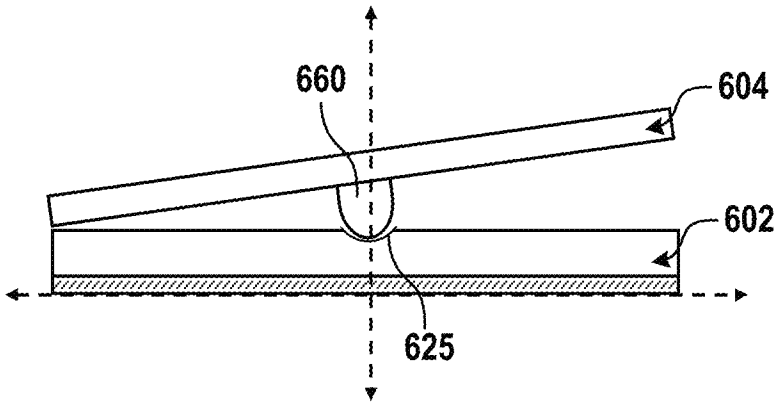
FIGS. 10A-10D illustrate a set of side elevation views of various embodiments of the golf training device of FIG. 1 featuring various types of top fulcrums and top fulcrum seats.
Figure 10B:
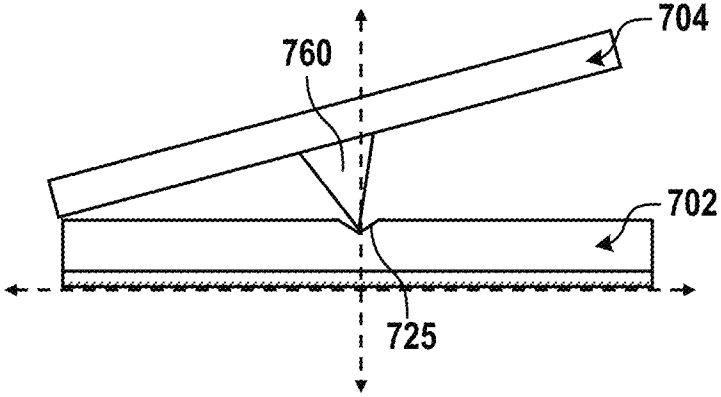
Figure 10C:
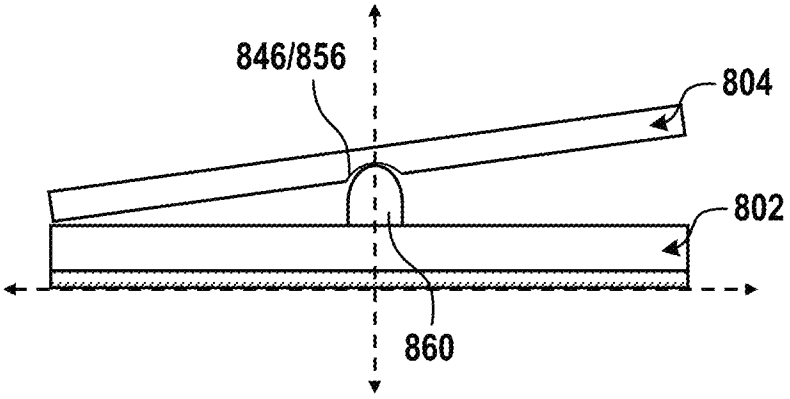
Figure 10D:
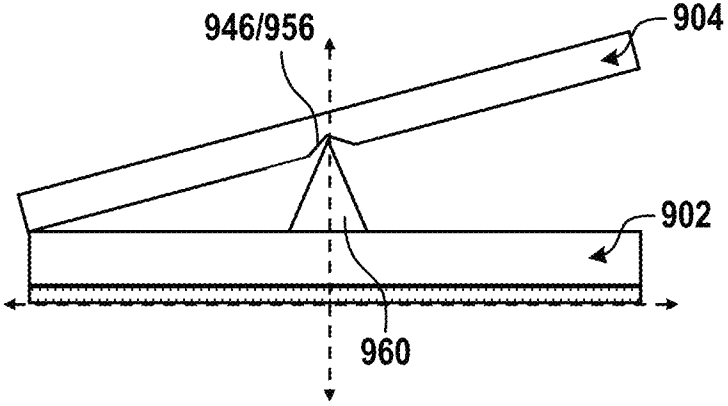

FIG. 10C shows a converse arrangement in which a top fulcrum 860 is integral to a baseboard 802 and a pedal assembly 804 provides a front fulcrum seat 846 (or back fulcrum seat 856) for receipt and alignment of top fulcrum 860 of baseboard 802. Top fulcrum 860 of baseboard 802 defines a semi-circular or rounded cross-section that interfaces with the semi-circular or rounded cross-section of front fulcrum seat 846 (or back fulcrum seat 856). Similarly, FIG. 10D shows an arrangement in which a top fulcrum 960 is integral to a baseboard 902 and a pedal assembly 904 of provides a front fulcrum seat 946 (or a back fulcrum seat 956) for receipt and alignment of top fulcrum 960 of baseboard 902. Top fulcrum 960 of baseboard 902 defines a triangular or pointed cross-section that interfaces with the front fulcrum seat 946 (or back fulcrum seat 956).

Figure 11A:
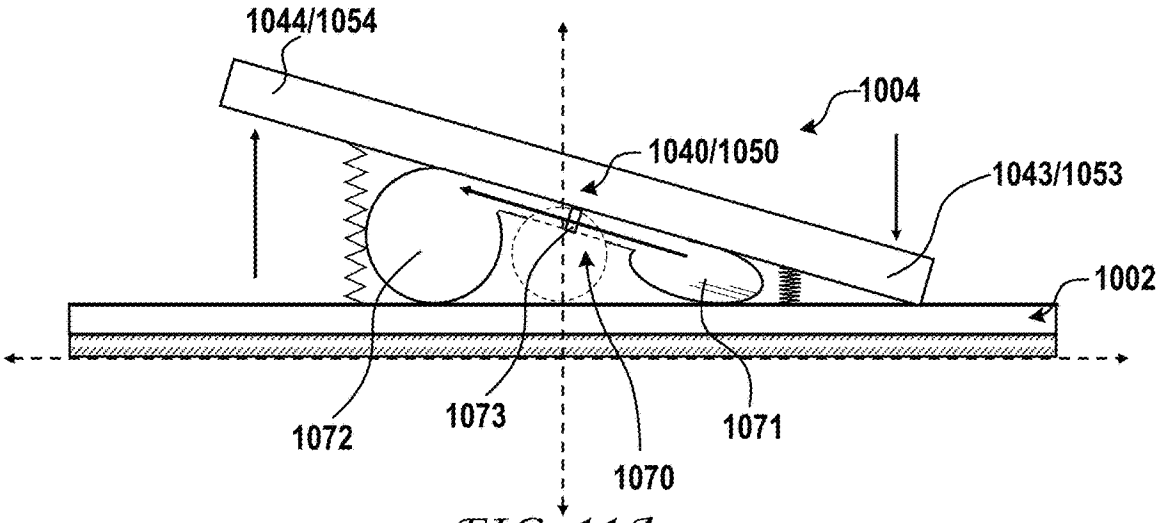
FIGS. 11A and 11B illustrate a set of side elevation views of various resistive mechanisms of the golf training device of FIG. 1 including a pneumatic resistive mechanism and a friction-based resistive mechanism.
Figure 11B:
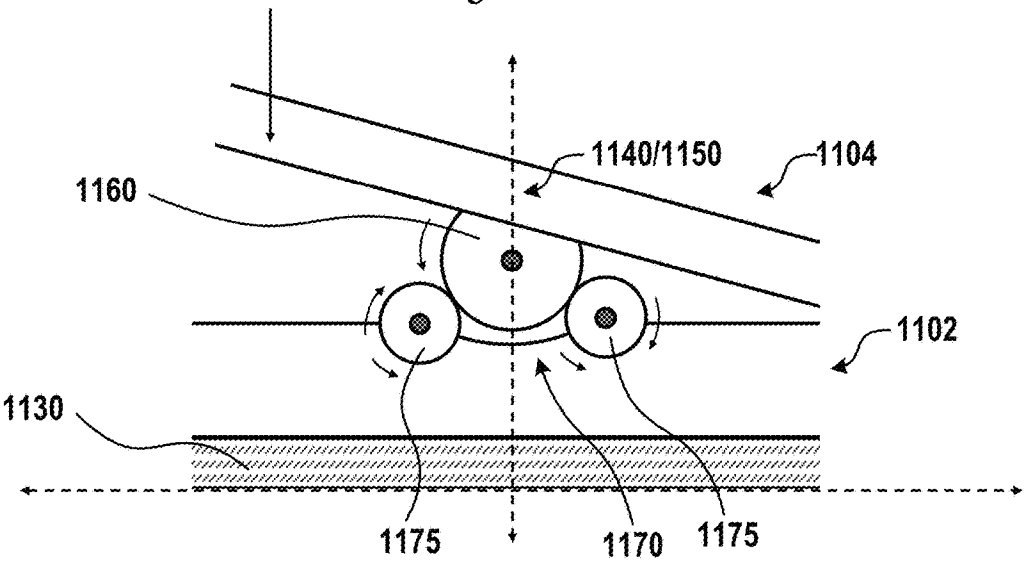

FIGS. 11A and 11B illustrate various resistive mechanisms of swing training device 100 that can associate with baseboard 102 or pedal assembly 104 for providing mechanical resistance to rotation of baseboard 102 or pedal assembly 104. In particular, FIG. 11A illustrates an example pneumatic resistive mechanism 1070 positioned between a baseboard 1002 and a front pedal 1040 (or a back pedal 1050) of a pedal assembly 1004. The pneumatic resistive mechanism 1070 includes a first air bladder 1071 in fluid flow communication with a second air bladder 1072 connected by a resistive valve 1073. First air bladder 1071 can be underneath a front heel portion 1043 of front pedal 1040 or a back heel portion 1053 of back pedal 1050, and second air bladder 1072 can be underneath a front toe portion 1044 of front pedal 1040 or a back toe portion 1054 of back pedal 1050. The following example will be discussed in terms of back pedal 1050, but it should be noted that the same applies to the front pedal 1040. In the example shown, during the backswing as the athlete forces back heel portion 1053 of back pedal 1050 downward towards baseboard 1002, first air bladder 1071 compresses and forces air into second air bladder 1072 as associated back toe portion 1054 of back pedal 1050 consequently raises in the vertical direction relative to baseboard 1002. During the follow-through swing, as the athlete forces the back toe portion 1054 of back pedal 1050 downward towards baseboard 1002 during the follow-through swing, second air bladder 1072 compresses and forces air into first air bladder 1071 as associated back heel portion 1053 of back pedal 1050 consequently raises in the vertical direction relative to baseboard 1002.

FIG. 11B shows an example of a friction-based resistive mechanism 1170 like that of FIG. 8C providing one or more resistive rollers 1175 that contact a top fulcrum 1160 and resist, but eventually permit, rotation of top fulcrum 1160 about the pedal axis $A_P$ to rotate a front pedal 1140 or a back pedal 1150 of a pedal assembly 1104. As previously shown, friction-based resistive mechanism 1170 can extend to a bottom fulcrum 1130 as well to provide resistance to the rotation of a baseboard 1102 about the baseboard axis $A_B$. Optionally, other resistive mechanisms can be included, such as a spring-based resistive mechanism (not shown) that provides a first spring (not shown) underneath front heel portion 143 or of front pedal 140 or back heel portion 153 of back pedal 150 and a second spring (not shown) underneath front toe portion 144 of front pedal 140 or back toe portion 154 of back pedal 150. The first spring and the second spring can be configured to resist compression or tension.

Figure 12A:
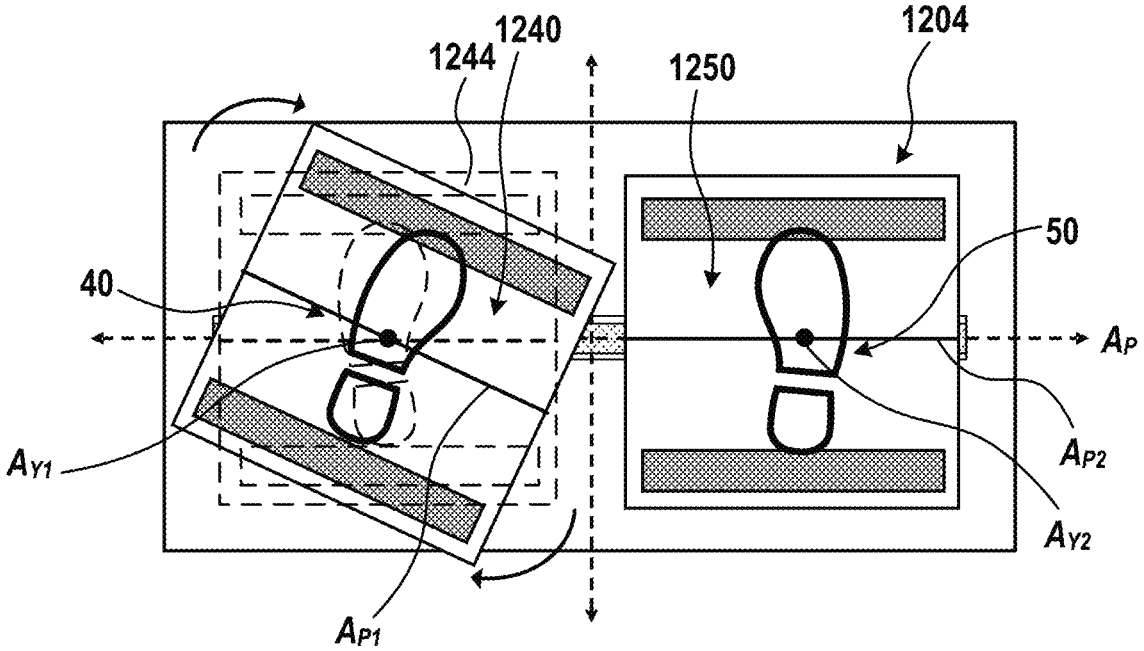
FIGS. 12A and 12B illustrate a set of views of the pedal assembly of the golf training device of FIG. 1 showing "yaw" rotation of the front and back pedals in a "backswing tilt" position and a "follow-through" tilt position.
Figure 12B:
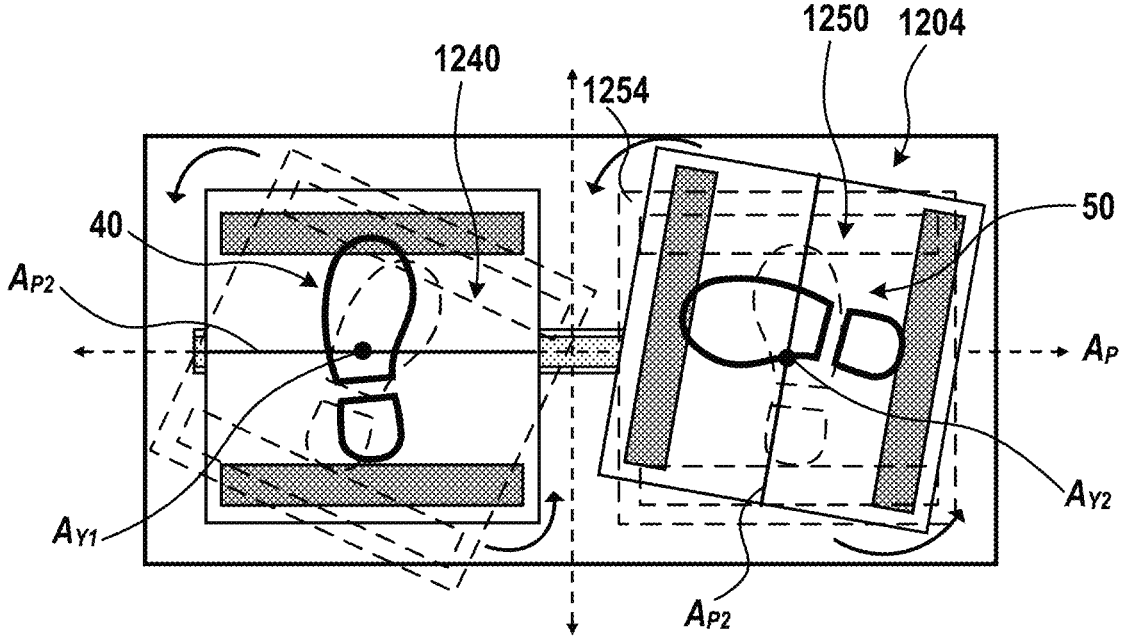

Referring to FIGS. 12A and 12B, in some embodiments a pedal assembly 1204 enables "yaw" rotation of a front pedal 1240 and a back pedal 1250 of pedal assembly 1204, as a typical golf swing (or baseball swing, hockey swing, etc.) can involve pivoting of the front foot 40 and the back foot 50 between the "backswing tilt" position and a "follow-through" tilt position as the hips rotate between the "backswing tilt" position and a "follow-through" tilt position. As shown, front pedal 1240 can pivot about a first yaw axis $A_{Y1}$ of rotation and back pedal 1250 can pivot about a second yaw axis $A_{Y2}$ of rotation. As shown, first yaw axis $A_{Y1}$ extends normal to a plane defined by front pedal 1240 and second yaw axis $A_{Y1}$ extends normal to a plane defined by back pedal 1250. In previous examples shown, such as in the examples of FIGS. 2A and 2B, the pedal axis $A_P$ for front and back pedals 140 and 150 is the same axis, however, in the examples of FIGS. 12A-13D, front and back pedals 1240 and 1250 can each independently rotate about their respective yaw axes $A_{Y1}$ and $A_{Y2}$ such that the front pedal 1240 defines a first pedal axis $A_{P1}$ and the back pedal 1250 defines a second pedal axis $A_{P2}$ which can extend along the same horizontal plane as the pedal axis $A_P$ but can each rotate about their respective yaw axes $A_{Y1}$ and $A_{Y2}$.

In particular, FIG. 12A illustrates clockwise "yaw" pivoting of the front foot 40 on front pedal 1240 about first yaw axis $A_{Y1}$ in the "backswing tilt" position as the athlete "charges" their swing and rotates their hips towards their back foot 50. FIG. 12A shows a starting "default" orientation of the front pedal 1240 in phantom, with a toe portion 1244 of front pedal 1240 facing perpendicular to pedal axis $A_P$, and a secondary "pivoting" orientation of front pedal 1240 as the athlete transitions to the "backswing tilt" position in which their hips rotate towards their back foot 50. As shown, an example secondary "pivoting" orientation of front pedal 1240 about first yaw axis $A_{Y1}$ shows an angle of about 25 degrees relative to the starting "default" orientation, however it should be noted that the secondary "pivoting" orientation is not limited to this value.

FIG. 12B illustrates counterclockwise "yaw" pivoting of back foot 50 on back pedal 1250 about second yaw axis $A_{Y2}$ as the athlete transitions to the "follow-through" position to complete their swing as the athlete rotates their hips towards their front foot 40. In particular, FIG. 12B illustrates a starting "default" orientation of back pedal 1250 in phantom, with a toe portion 1254 of back pedal 1250 facing perpendicular to pedal axis $A_P$, and a tertiary "pivoting" orientation of back pedal 1250 that occurs when transitioning to the "follow-through" position. As shown, an example tertiary "pivoting" orientation of back pedal 1250 about second yaw axis $A_{Y2}$ shows an angle of about 80 degrees relative to the starting "default" orientation, but the tertiary "pivoting" orientation is not limited to this value. During the transition to the "follow-through" position, front pedal 1240 can rotate in the counterclockwise direction about first yaw axis $A_{Y1}$ from the secondary "pivoting" orientation shown in phantom back to the starting "default" orientation.

FIGS. 13A-13D illustrate an example top fulcrum 1260 that includes a front top fulcrum 1262 and a back top fulcrum 1264 that respectively enable independent "yaw" rotation of front and back pedals 1240 and 1250 of the pedal assembly 1204 illustrated in FIGS. 12A and 12B. The top fulcrum 1260 includes a front bearing 1280 that permits front pedal 1240 to pivot about a first yaw axis $A_{Y1}$ and a back bearing 1290 that permits back pedal 1250 to pivot about a second yaw axis $A_{Y2}$.

As shown, front bearing 1280 couples front pedal 1240 with front top fulcrum 1262 and back bearing 1290 couples back pedal 1250 with back top fulcrum 1264. In one example, front bearing 1280 includes a housing 1281 having a top surface 1282 and a bottom surface 1283, bottom surface 1283 of front bearing 1280 being integral with front top fulcrum 1262 and top surface 1282 of front bearing 1280 coupling with a bottom surface 1242 of front pedal 1240. Top surface 1282 of front bearing 1280 defines a coupling retainer 1286 that engages a yaw coupling recess 1247 defined along bottom surface 1242 of front pedal 1240 such that front pedal 1240 rotates about first yaw axis $A_{Y1}$ and first pedal axis $A_{P1}$ when coupled with front bearing 1280. As further shown, top surface 1282 of front bearing 1280 defines a bearing channel 1284 that provides a recess for a plurality of ball bearings 1285 that aid rotation of front pedal 1240 about first yaw axis $A_{Y1}$.

Similarly, back bearing 1290 includes a housing 1291 having a top surface 1292 and a bottom surface 1293, bottom surface 1293 of back bearing 1290 being integral with back top fulcrum 1264 and top surface 1292 of back bearing 1290 being configured to engage a bottom surface 1252 of back pedal 1250. Top surface 1292 of back bearing 1290 defines a coupling retainer 1296 that engages a yaw coupling recess 1257 defined along bottom surface 1252 of back pedal 1250 such that back pedal 1250 can rotate about second yaw axis $A_{Y2}$ and second pedal axis $A_{P2}$ when coupled with back bearing 1290. As further shown, top surface 1292 of back bearing 1290 defines a bearing channel 1294 that provides a recess for a plurality of ball bearings 1295 that aid rotation of the back pedal 1250 about the second yaw axis $A_{Y2}$.

Figure 13B:
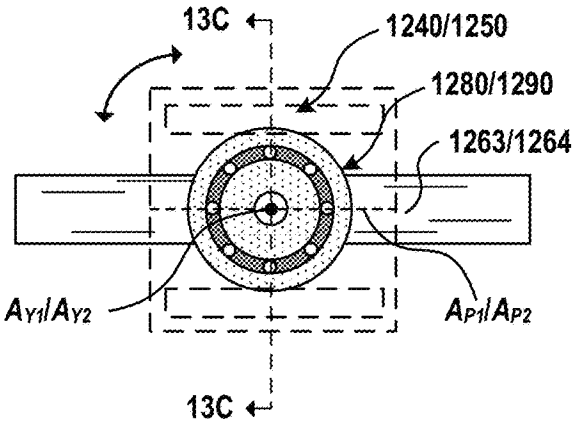
FIGS. 13A-13D illustrate a set of views of the pedal assembly of the golf training device of FIG. 1, showing a top plan view, a top plan view with a front or back pedal in phantom, and a cross-sectional side view of a bearing that enables "yaw" rotation of the front and back pedals of the golf training device of FIG. 1, with an additional top plan view showing various components that limit yaw rotation.
Figure 13D:
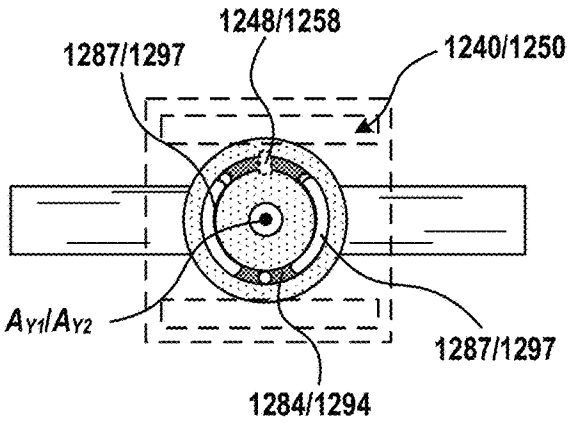
Figure 13A:
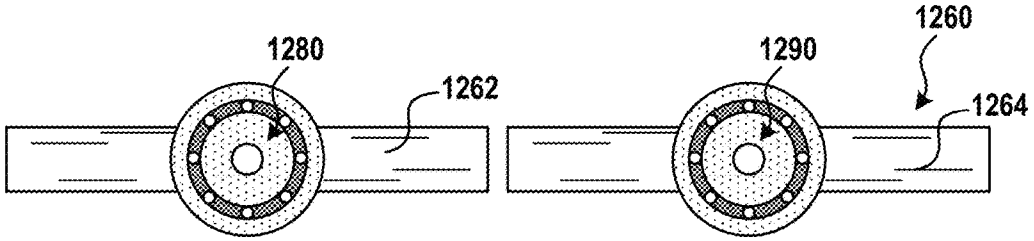
Figure 13C:
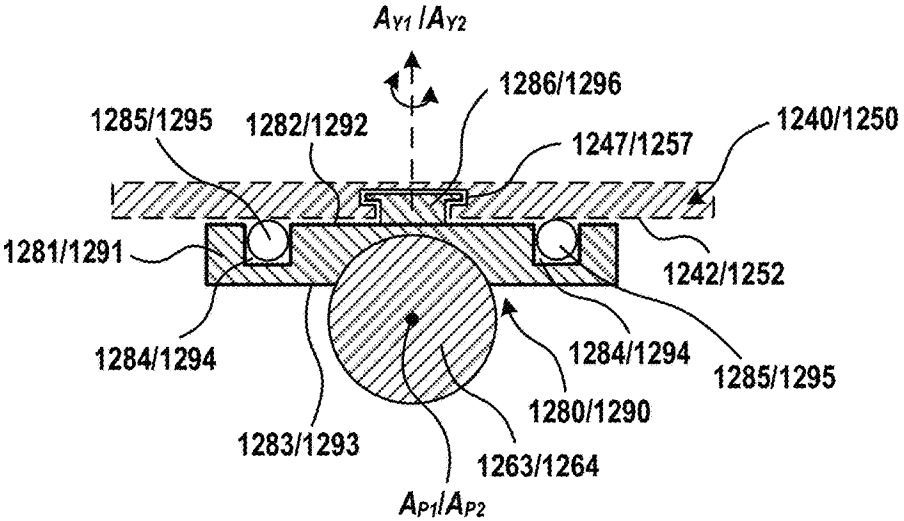

Further, in the embodiment shown in FIGS. 13A and 13B, front bearing 1280 is positioned on top of front top fulcrum 1262 and enables "yaw" rotation of the front pedal 1240 about first yaw axis $A_{Y1}$. Back bearing 1290 is positioned on top of back top fulcrum 1264 and enables "yaw" rotation of back pedal 1250 second yaw axis $A_{Y2}$. However, it should be noted that an alternative configuration is possible where the front and back bearings and are each located underneath the front top fulcrum and the back top fulcrum and can rotate the front top fulcrum and the back top fulcrum along with the front and back pedals.

In some embodiments, front bearing 1280 can limit a range of rotation of front pedal 1240 about first yaw axis $A_{Y1}$ and back bearing 1290 can limit a range of rotation of back pedal 1250 about second yaw axis $A_{Y2}$. This may be accomplished by one or more stop blocks or rails that restrict the range of motion. For instance, as shown in FIG. 13D, bearing channel 1284 (or 1294) can include one or more stop blocks 1287 (or 1297) that contact a track follower 1248 (or 1258) located underneath front pedal 1240 (or back pedal 1250) and prevent further rotation of associated front pedal 1240 (or back pedal 1250) about first yaw axis $A_{Y1}$ (or the second yaw axis $A_{Y2}$).

Alternatively, front and back pedals of pedal assembly can engage the baseboard by one or more multi-dimensional bearings that provide individual rotation of front and back pedals and about pedal axis $A_P$ in addition to first and second yaw axes $A_{Y1}$ and $A_{Y2}$.

Figure 14:
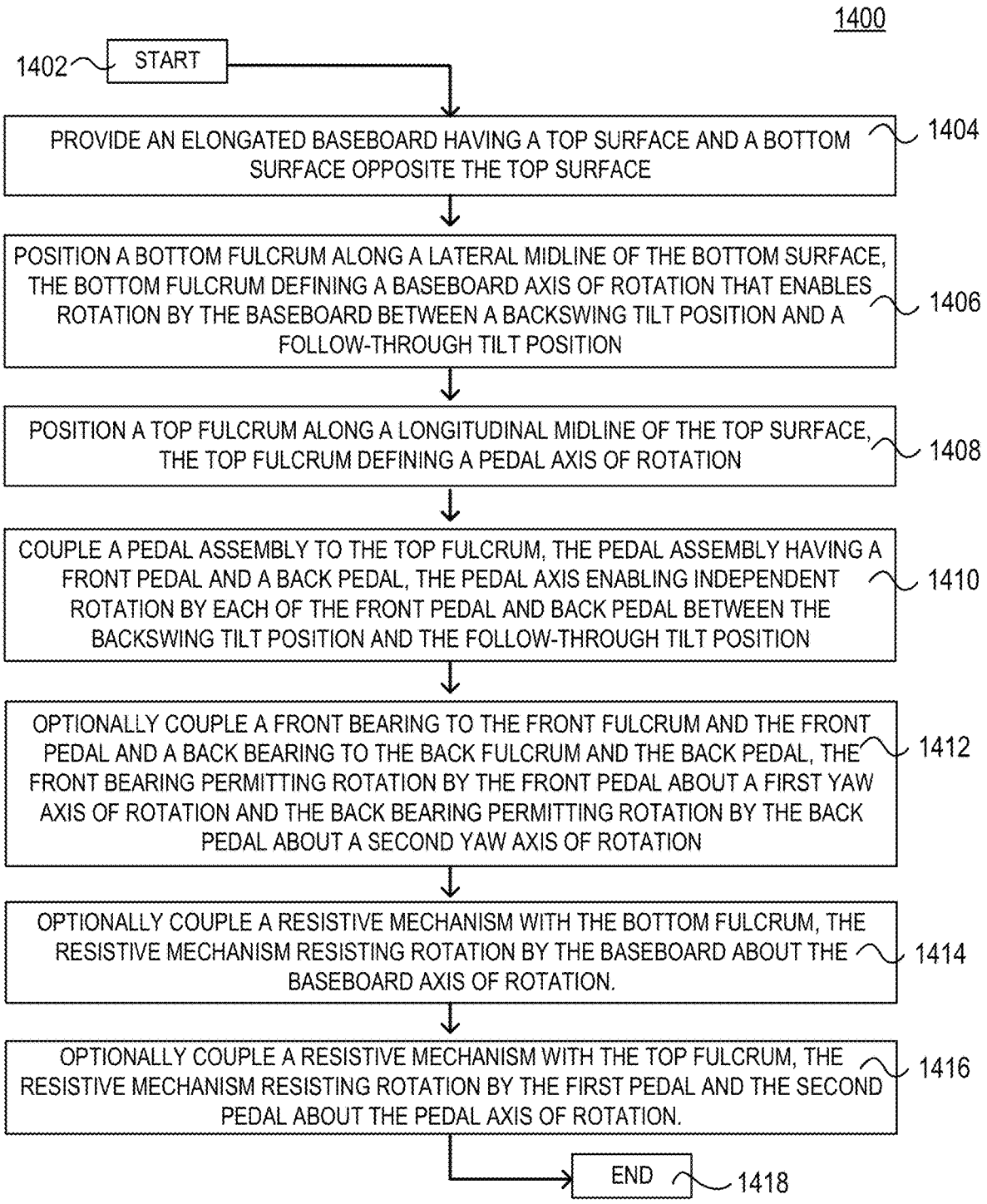
FIG. 14 illustrates a process flow showing an example simplified procedure for manufacture of the golf training device of FIG. 1.

FIG. 14 illustrates an example simplified method 1400 for manufacture of a swing training device 100 in accordance with the examples and processes described above.

Method 1400 begins at step 1402, and continues to step 1404, where, as described above, the manufacturer provides a baseboard having a top surface and a bottom surface opposite the top surface.

Method 1400 continues to step 1406, where the manufacturer positions a bottom fulcrum along a lateral midline of the bottom surface, the bottom fulcrum defining a baseboard axis of rotation that enables rotation by the baseboard between a backswing tilt position and a follow-through tilt position.

At step 1408, the manufacturer positions a top fulcrum along a longitudinal midline of the top surface, the top fulcrum defining a pedal axis of rotation. At step 1410, the manufacturer couples a pedal assembly to the top fulcrum, the pedal assembly having a front pedal and a back pedal, the pedal axis enabling independent rotation by each of the front pedal and back pedal between the backswing tilt position and the follow-through tilt position.

At step 1412, the manufacturer optionally couples a front bearing to the front fulcrum and the front pedal and a back bearing to the back fulcrum and the back pedal, the front bearing permitting rotation by the front pedal about a first yaw axis and the back bearing permitting rotation by the back pedal about a second yaw axis.

At step 1414, the manufacturer optionally couples a resistive mechanism with the bottom fulcrum, the resistive mechanism resisting rotation by the baseboard about the baseboard axis of rotation. At step 1416, the manufacturer optionally couples a resistive mechanism with the top fulcrum, the resistive mechanism resisting rotation by the first pedal and the second pedal about the pedal axis of rotation.

Method 1400 subsequently ends at step 1418.

It should be noted that certain steps within method 1400 may be optional, and further, the steps shown in FIG. 14 are merely examples for illustration—certain other steps may be included or excluded as desired. Further, while a particular order of the steps is shown, this ordering is merely illustrative, and any suitable arrangement of the steps may be utilized without departing from the scope of the embodiments herein. For instance, steps 1408 and 1410 can be performed in either order, depending on the embodiment, to reflect that the top fulcrum can either be integral with the baseboard or the pedal assembly. Further, steps 1412, 1414 and 1416 can be completed before or after steps 1406 or 1408 to reflect that the resistive mechanism can be coupled with the baseboard or the pedal assembly at any point within the process.

While there have been shown and described illustrative embodiments of a swing training device, it is to be understood that various other adaptations and modifications may be made within the spirit and scope of the embodiments herein. For example, the embodiments have been shown and described herein with relation to a specific device that aids a golf swing. However, the embodiments in their broader sense are not as limited, and may, in fact, be used in accordance with another type of swing, such as a baseball swing or a hockey swing.

The foregoing description has been directed to specific embodiments. It will be apparent, however, that other variations and modifications may be made to the described embodiments, with the attainment of some or all of their advantages. Accordingly this description is to be taken only by way of example and not to otherwise limit the scope of the embodiments herein. Therefore, it is the object of the appended claims to cover all such variations and modifications as come within the true spirit and scope of the embodiments herein.

The invention claimed is:

1. A swing training device, comprising:

a baseboard;

a bottom fulcrum associated with a bottom of the baseboard, the baseboard is configured to rotate about the bottom fulcrum between a backswing position and a follow-through position;

a top fulcrum associated with a top of the baseboard;

a front pedal coupled to a first portion of the top fulcrum, the front pedal is configured to rotate about the top fulcrum between the backswing position and the follow-through position; and a back pedal coupled to a second portion of the top fulcrum, the back pedal is configured to independently rotate about the top fulcrum between the backswing position and the follow-through position.

2. The swing training device of claim 1, wherein a portion of the baseboard is configured to contact a ground surface in at least one of the backswing position or the follow-through position, and wherein a respective portion of the front pedal and a respective portion of the back pedal are configured to contact a top surface of the baseboard in the backswing position or the follow-through position.

3. The swing training device of claim 1, further comprising a resistive element configured to resist rotation by the baseboard between the backswing position and the follow-through position.

4. The swing training device of claim 1, further comprising a resistive element configured to resist rotation by at least one of the front pedal or back pedal between the backswing position and the follow-through position.

5. The swing training device of claim 1, further comprising one or more resistive elements configured to resist rotation by at least one of the baseboard, the front pedal, or the back pedal between the backswing position and the follow-through position, wherein the resistive element includes at least one of a resistive roller, a resistive bearing, a resistive spring, or a resistive pneumatic mechanism.

6. The swing training device of claim 1, wherein the top fulcrum is configured to enable at least one of the front pedal or the back pedal to rotate about the top fulcrum according to one or more of a pitch axis or yaw axis.

7. The swing training device of claim 1, wherein at least one of the bottom fulcrum or the top fulcrum has a semicircular configuration.

8. The swing training device of claim 1, wherein the top fulcrum further comprises two fulcrums that include a first fulcrum providing the first portion of the top fulcrum and a second fulcrum providing the second portion of the top fulcrum.

9. The swing training device of claim 1, further comprising one or more friction grip elements associated with at least one of the front pedal or the back pedal, the one or more friction grip elements configured to prevent slipping.

10. The swing training device of claim 1, wherein the front pedal and the back pedal each comprise a respective toe portion and heel portion, wherein each respective toe portion and heel portion is configured to rotate about the top fulcrum.

11. The swing training device of claim 1, wherein the front pedal and the back pedal form a pedal assembly.

12. A swing training device, comprising:

a baseboard;

a bottom fulcrum having a semicircular shape associated with a bottom of the baseboard, the baseboard is configured to rotate about the bottom fulcrum between a backswing position and a follow-through position;

a resistive element associated with the bottom fulcrum, the resistive element is configured to resist rotation by the baseboard;

a top fulcrum associated with a top of the baseboard;

a front pedal coupled to a first portion of the top fulcrum, the front pedal is configured to rotate about the top fulcrum between the backswing position and the follow-through position;

a back pedal coupled to a second portion of the top fulcrum, the back pedal is configured to independently rotate about the top fulcrum between the backswing position and the follow-through position.

13. The swing training device of claim 12, wherein the resistive element is a first resistive element, wherein the swing training device further comprises a second resistive element associated with at least one of the front pedal or the back pedal, the second resistive element is configured to resist rotation by the at least one of the front pedal or the back pedal.

* * * * *